US007681988B2

(12) United States Patent
Mizutani

(10) Patent No.: US 7,681,988 B2
(45) Date of Patent: Mar. 23, 2010

(54) INK JET RECORDING HEAD AND INK JET RECORDING APPARATUS WITH NOZZLE MEMBER HAVING AN INK-REPELLENT LAYER

(75) Inventor: Michinari Mizutani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 818 days.

(21) Appl. No.: 11/468,929

(22) Filed: Aug. 31, 2006

(65) Prior Publication Data

US 2007/0057997 A1 Mar. 15, 2007

(30) Foreign Application Priority Data

Sep. 5, 2005 (JP) ..... 2005-256522

(51) Int. Cl.
*B41J 2/14* (2006.01)
*B41J 2/135* (2006.01)

(52) U.S. Cl. ..... 347/47; 347/45

(58) Field of Classification Search ..... 347/56, 347/47, 45, 44, 55; 216/27
See application file for complete search history.

(56) References Cited

U.S. PATENT DOCUMENTS 4,413,268 A * 11/1983 Bentin ..... 347/47
4,707,705 A 11/1987 Hara
4,728,392 A 3/1988 Miura
4,801,955 A * 1/1989 Miura et al. ..... 347/55
6,523,762 B1 2/2003 Luginbuhl
6,569,343 B1 * 5/2003 Suzuki et al. ..... 216/27
2005/0264612 A1 * 12/2005 Silverbrook ..... 347/56

FOREIGN PATENT DOCUMENTS

| | | | |
|---|---|---|---|
| EP | 1693208 | A | 8/2006 |
| JP | 11-320893 | A | 11/1999 |
| JP | 2000-326515 | | 11/2000 |
| JP | 2001-071510 | | 3/2001 |
| WO | 0006388 | A | 2/2000 |

* cited by examiner

*Primary Examiner*—Manish S Shah
*Assistant Examiner*—Carlos A Martinez, Jr.
(74) *Attorney, Agent, or Firm*—Canon USA Inc IP Div

(57) ABSTRACT

An inkjet recording head using pigment ink as discharged ink includes a nozzle member having a nozzle for discharging ink. The nozzle member has an ink-repellent layer forming a discharge port face having a discharge port that is an open end of the nozzle. The ink jet recording head further includes a projection portion positioned around the discharge port and protruding along a central axis of the nozzle with respect to the discharge port face. The nozzle, in a cross section passing through the central axis of the nozzle, has an outline shape provided with a curved line having a changing curvature radius. A point at which the curvature radius of the curved line is minimum is included in the projection portion and has a maximum height from the discharge port face in the cross section.

5 Claims, 6 Drawing Sheets

INK JET RECORDING HEAD AND INK JET RECORDING APPARATUS WITH NOZZLE MEMBER HAVING AN INK-REPELLENT LAYER

BACKGROUND OF THE INVENTION

1. Field of the Invention

The present invention relates to an ink jet recording head adapted to perform recording on a recording medium by discharging ink from a discharge port, and to an ink jet recording apparatus including the ink jet recording head.

2. Description of the Related Art

An ink jet recording apparatus performs recording by discharging ink droplets from a discharge port provided in an ink jet recording head, and applying the ink droplets to a recording medium such as paper or resin sheet. A conventional ink jet recording head includes a substrate bearing an energy generating element, a flow path member bonded to the substrate for forming ink flow paths, and an orifice plate bonded to the flow path member and having an ink discharge port. The energy generating element is provided in a position corresponding to the ink flow path, which is used to generate energy to discharge ink. Examples of the energy generating element include an electrothermal converting element such as a heating resistance element, a piezoelectric element, and so forth.

Ink mist accompanying the discharged ink droplets is also generated by the inkjet recording head when ink is repeatedly discharged. Ink mist may cause the problem of displacing an ink discharge direction when the ink mist adheres to the discharge port face of the inkjet recording head. FIGS. 8A to 8D illustrate this problem.

FIG. 8A shows a state of ink mist 110*a* adhering on the discharge port face surface (100*a*) near a discharge port 101 on an orifice plate 100. When ink 110 is discharged in this state, the ink 110 is drawn towards and combined with the ink mist 110*a* that adheres to the discharge port face 100*a*, after passing through the discharge port 101, as shown in FIG. 8B. As a result, a displacement in the ink discharge direction of the ink 110 occurs at the discharge port 101 as shown in FIGS. 8C and 8D. When the ink discharge direction is displaced, an impact position of the ink 110 onto a recording medium is displaced, thus degrading the image quality. The displacement of the ink discharge direction is also referred to as a "drag".

In order to prevent the displacement of the ink discharge direction caused by ink adhering to the discharge port face, a conventional ink jet recording apparatus is configured to perform a wiping process for wiping off the ink adhering to the discharge port face of the ink jet recording head using a blade made of rubber. However, the ink that adheres to the discharge port face cannot be completely wiped off even after the wiping process, so that the some ink still remains on the discharge port face in some cases.

Japanese Patent Application Laid-Open No. 2000-326515 discusses applying a water-repellent (ink-repellent) treatment to the discharge port face in order to effectively wipe off the ink adhering to the discharge port face. Moreover, Japanese Patent Application Laid-Open No. 2001-71510 discusses an ink jet recording head having an orifice plate in which a protective film having an ink-repellent property is formed at an inner side of the discharge port, a top end portion of the protective film is made to protrude from the discharge port face, and an ink-repellent film is formed throughout the discharge port face. The protective film protruding from the discharge port face is configured, during the process for forming the orifice plate, by forming a protective film having an ink-repellent property on the inner wall of the discharge port, and then performing etching to remove a surface of the orifice plate while leaving the protective film.

In general, ink for use with an ink jet recording head includes dye ink (dye-based ink) and pigment ink (pigment-based ink). The dye ink is used to print a high-resolution image such as photographs. The pigment ink is used to print characters or the like. The pigment ink has a characteristic that it can firmly adhere to a material surface compared to the dye ink. Accordingly, a contact angle of an ink-repellent layer of the ink jet recording head using the pigment ink is made larger than that using the dye ink, so that ink can be prevented from adhering to the orifice plate surface.

On the other hand, in recent years, the pigment ink is often used to achieve high-resolution printed matter and improve its preservation. In this case, compared with the case of printing characters, the amount of discharge of ink drops is very small such as about several pl (pico liter), and the nozzle array density is about 1200 dpi. Here, when a conventional ink-repellent layer is provided on the orifice plate, it is newly found that the contact angle decreases in part in some places adjacent the discharge port, that is, a deterioration of the ink-repellent layer occurs near the discharge port, regardless of the presence of ink firmly adhering to the orifice plate.

This phenomenon is not observed in ink jet recording heads using dye ink. The problem has recently been detected in a recording head having a high density array for discharging minute droplets using pigment ink to record a high-resolution image as described above.

SUMMARY OF THE INVENTION

The present invention is directed to an ink jet recording head and an ink jet recording apparatus in which an ink discharge direction can be made stable by preventing or reducing the deterioration of an ink-repellent layer even in a case where pigment ink is discharged from a recording head having a high array density for discharging minute ink droplets.

According to an aspect of the present invention, an ink jet recording head using pigment ink as discharged ink includes a nozzle member having one or more nozzles for discharging ink, the nozzle member having an ink-repellent layer forming a discharge port face having a discharge port that is an open end of the one or more nozzles, and a projection portion positioned around the discharge port and protruding along a central axis direction of the one or more nozzles away from the discharge port face, wherein the one or more nozzles, in a cross section passing through the central axis of the nozzle, has an outline shape provided with a curved line having a changing radius of curvature, and wherein a point at which the radius of curvature of the curved line is a minimum is included in the projection portion and is located at a maximum height from the discharge port face in the central axis direction.

According to another aspect of the present invention, an ink jet recording head using pigment ink as discharged ink includes a nozzle member having a nozzle for discharging ink, the nozzle member having an ink-repellent layer forming a discharge port face having a discharge port that is an open end of the nozzle, and a projection portion positioned around the discharge port and protruding along a central axis direction of the nozzle with respect to the discharge port face, wherein the nozzle, in a cross section passing through the central axis of the nozzle, has an outline shape provided with a curved line having a changing radius of curvature, wherein an angle defined by tangent lines at points at which the curvature radius of the curved line is maximum and which are nearest to a boundary point at which the curvature radius of the curved line is minimum inside and outside the nozzle with respect to the boundary point is equal to or greater than 40° and equal to or less than 75°, and wherein a height of the projection portion from the discharge port face along the central axis direction of the nozzle is equal to or greater than 0.05 μm and less than 0.5 μm.

According to an aspect of the present invention, since the projection portion is provided around the discharge port as described above, ink coagulation can hardly be generated in the nozzle even if pigment ink is used. Thus, the ink-repellent layer on the discharge port face is excellently maintained even if the wiping processing on the discharge port face is repeated. As a result, the displacement of a ink discharge direction caused by ink adhering to the discharge port face can effectively be prevented or reduced to facilitate stably discharging ink.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments of the invention and, together with the description, serve to explain the principles of the invention.

DETAILED DESCRIPTION OF THE EMBODIMENTS

Exemplary embodiments of the invention will be described in detail below with reference to the drawings.

First of all, a mechanism of deterioration of an ink-repellent property is described below in a case where an ink-repellent layer is formed on a discharge port face of an ink jet recording head using pigment ink as discharged ink.

Figure 1:
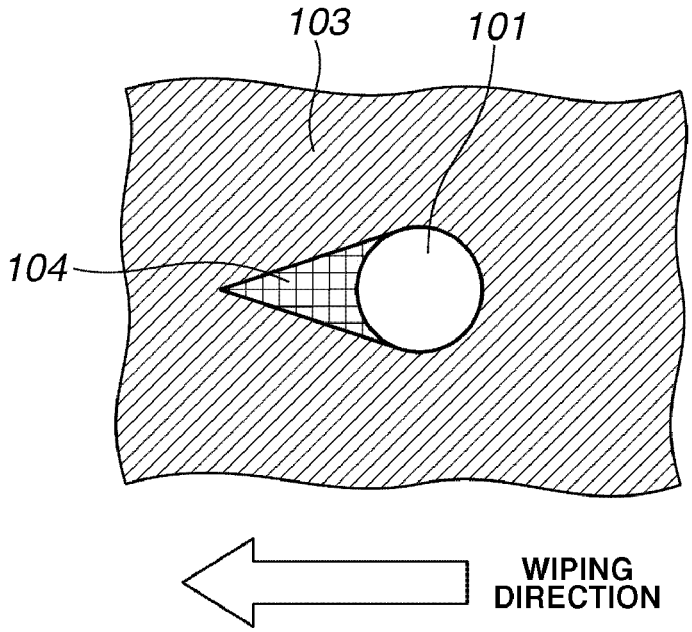
FIG. 1 is a plan view of the vicinity of a discharge port, showing a deteriorated state of an ink-repellent property, in a conventional ink jet recording head having no projection portion on a discharge port face.

In order to analyze a mechanism of deterioration of an ink-repellent property, the inventor of the present invention observed a discharge port face of a conventional ink jet recording head, which does not have a projection portion around a discharge port, where a displacement of an ink discharge direction occurred. As a result of observation, an area 104 susceptible to wetting with ink was found to exist on a discharge port face, as illustrated in FIG. 1. In the area 104 susceptible to wetting, an ink-repellent layer 103 had been removed from the discharge port face. The area 104 susceptible to wetting is adjacent to a discharge port 101 and extends to a downstream side with respect to a wiping direction in which the wiping process is performed.

Figure 2:
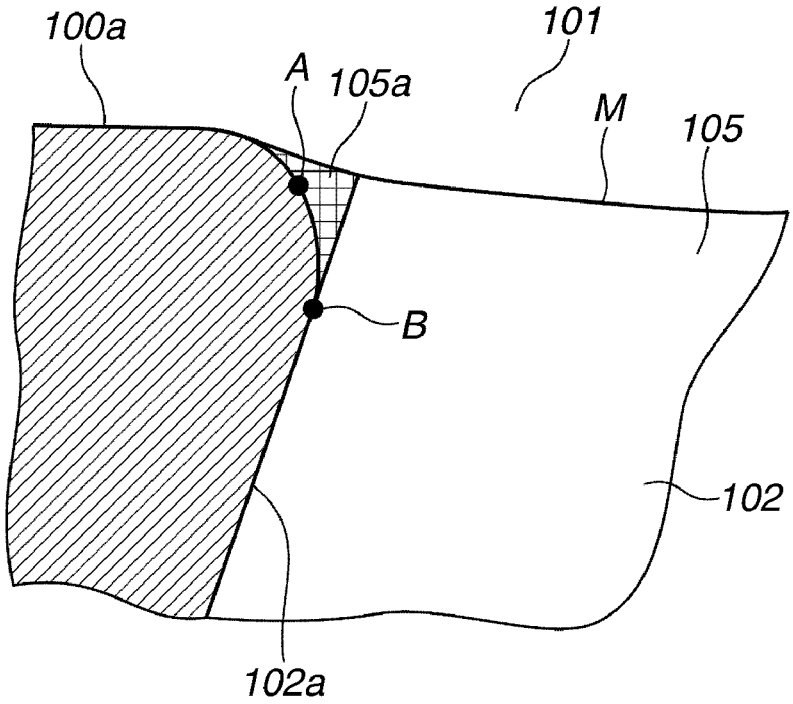
FIG. 2 is an enlarged cross-sectional view of the vicinity of the discharge port in the ink jet recording head shown in FIG. 1.

Reasons why the ink-repellent layer 103 was removed can be thought as follows. As illustrated in a cross-sectional view shown in FIG. 2 (a cross section passing through a central axis (not shown) of a nozzle 102), ink 105 is held inside the nozzle 102. The ink 105 forms a meniscus M by the surface tension of the ink 105 itself. The nozzle 102 has a discharge port 101. The discharge port 101 in general has a minute diameter which ranges from ten to several tens of μm. A boundary between a discharge port face 100*a* and an inner side 102*a* of the nozzle 102 is configured by a continuous curved surface, when seen in a microscopic view. In this boundary, a curvature radius is changing continuously so as to gently connect the discharge port face 100*a* and the inner side 102*a* of the nozzle 102. Assuming that a point at which the curvature radius of an outline shape in the cross section of the nozzle 102 of the ink jet recording head is minimum is a point A, the point A is located in the ink 105. Note that an ink-repellent layer is not shown in FIG. 2.

Here, a behavior of the ink 105 is focused on when the ink 105 is discharged from the discharge port 101. When the ink 105 is discharged, the ink 105 is pushed out along the inner side 102*a* of the nozzle 102. In this case, because the boundary is configured by the curved surface as described above, the cross section of the nozzle 102 near the discharge port face 100*a* has a spread-out shape towards the ink discharge direction. Therefore, in a spread-out region of the cross section, there is only a little ink flow, and a stagnation of the ink 105 occurs easily in the state where ink is not being discharged. Now, consider an outline shape of the cross section near the discharge port 101 extending from the discharge port face 100*a* to the inner side 102*a* of the nozzle 102 via the point A. In this instance, a stagnation area 105*a* where the ink 105 is apt to stagnate is an area located outside a tangent line on the inner side 102*a* at a point B at which the curvature radius is maximum in a range from the point A to the inner side 102*a*. If a plurality of points at which the curvature radius is maximum in a range from the point A to the inner side 102*a* is present, the one nearest to the point A is taken as the point B.

Because the ink 105 can hardly flow in the stagnation area 105*a* when the ink 105 is not being discharged, the ink 105 is likely to coagulate therein. In an ink jet recording head having a high density array of nozzles, a specific nozzle is apt to remain in a nonuse state for a long time. When pigment ink is used in such an ink jet recording head, the above-mentioned coagulation phenomenon is prominent. Moreover, if the amount of discharge of ink is made small to achieve a high-resolution image, the size of a discharge port must also be small. The coagulation phenomenon is prominent compared to a larger discharge port. If the wiping process is performed in a condition where a coagulation of the ink 105 has been generated in the stagnation area 105*a*, a blade scrapes the coagulation from the nozzle 102 and directly rubs the coagulation onto the discharge port face 100*a*. The coagulation scraped from the nozzle 102 may act as abrasive grains to damage the ink-repellent layer 103 formed at the discharge port face 100*a*. When the wiping process is repeated, damage to the ink-repellent layer 103 is accumulated. As a result, the ink-repellent layer 103 is worn out eventually, and the area 104 susceptible to wetting shown in FIG. 1 is formed.

Therefore, the inventor of the present invention considered that the displacement of an ink discharge direction can be prevented or reduced if the stagnation area 105*a* mentioned above is reduced to decrease the coagulation so as to prevent a damage to the ink-repellent layer 103. As a result of the extensive studies conducted on how to reduce the stagnation area 105*a*, the inventor came up with a solution of making a geometrical shape extending from the discharge port face 100*a* to the inner side 102*a* of the nozzle 102 into a specific shape.

Figure 3A:
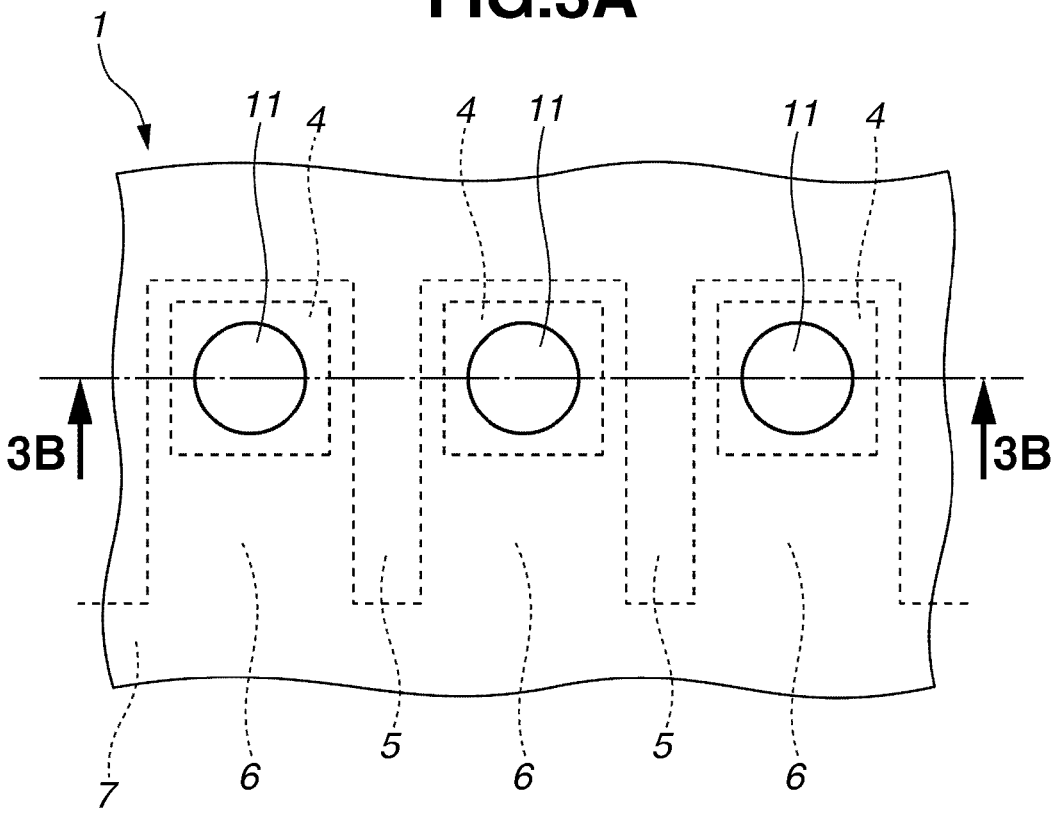
FIG. 3A is a plan view of an ink jet recording head according to an exemplary embodiment of the present invention, as viewed from a discharge port face.
Figure 3B:
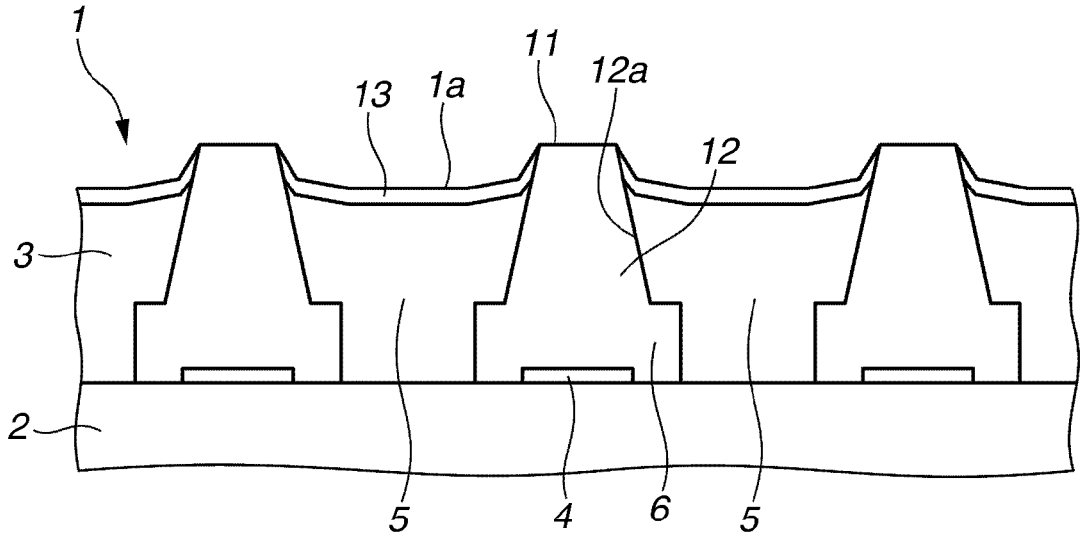
FIG. 3B is a cross-sectional view taken along line 3B-3B of FIG. 3A.

FIG. 3A is a plan view of an essential portion of an ink jet recording head according to an exemplary embodiment of the present invention, as viewed from a discharge port side. FIG. 3B is a cross-sectional view taken along line 3B-3B of FIG. 3A. FIG. 3B illustrates a cross section that passes through a central axis (shown by the dotted line in FIG. 3B) of a nozzle.

First of all, an overall structure of the ink jet recording head 1 is described. As shown in FIGS. 3A and 3B, the ink jet recording head 1 includes a substrate 2 bearing a plurality of heating resistance elements 4 as an energy generating element, and a nozzle member 3 bonded to an upper face of the substrate 2. The heating resistance elements 4 are disposed in a line such that the array density of a nozzle 12 is 600 dpi in the case of the present embodiment. However, for a color ink jet recording head, the heating resistance elements 4 can be arranged in a plurality of rows for the respective colors. A voltage is individually applied to each heating resistance element 4 via wiring (not shown).

In the nozzle member 3, at the positions facing the respective heating resistance elements 4, separate flow paths 6 partitioned by nozzle walls 5 are provided. Each of the separate flow paths 6 is connected with a nozzle 12. The nozzle 12 is opened at the discharge port 11. In the present embodiment, the amount of ink discharged from the nozzle 12 is 2 pl, and the diameter of the discharge port 11 is 17 μm. A face of the nozzle member 3 on which the discharge port 11 is provided is referred to as a discharge port face 1*a*. An ink-repellent layer 13 is formed on the discharge port face 1*a*. In addition, a common flow path 7 that connects the separate paths 6 with one another is formed in the nozzle member 3. The common flow path 7 is connected with a supply port (not shown), which is formed penetrating the substrate 2 in a thickness direction of the substrate 2.

Ink supplied from the supply port is supplied to the separate flow paths 6 through the common flow path 7. The ink supplied to the separate flow path 6 fills up the nozzle 12 while forming a meniscus near the discharge port 11. When a thermal energy is generated by conducting electricity to the heat resistance element 4 in such a condition, bubbles are generated in the ink on the heat resistance element 4 by film boiling, and the ink is then discharged from the discharge port 11 due to the pressure from the bubbles. The heating resistance element 4 is illustrated as an example of the energy generating element. However, in the present exemplary embodiment, other elements can be used arbitrarily as long as it can provide energy to discharge ink, for example, an electrothermal converting element such as a piezoelectric element.

Figure 4:
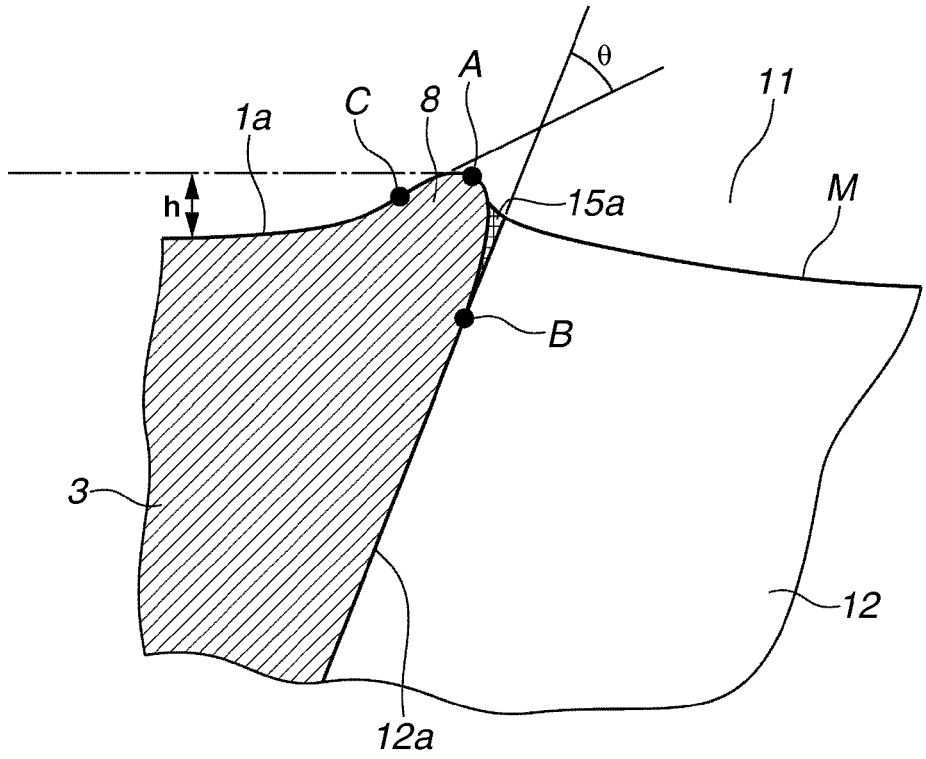
FIG. 4 is an enlarged cross-sectional view of the vicinity of a discharge port shown in FIG. 3B.

FIG. 4 illustrates an enlarged cross section near the discharge port 11 of the ink jet recording head according to an exemplary embodiment of the present invention. Note that the ink-repellent layer 13 is not shown in FIG. 4. As illustrated in FIG. 4, in the inkjet recording head of the present embodiment, the outline shape of the nozzle 12 in the cross section that passes through the central axis of the nozzle 12 has a curved line portion having a changing curvature radius. More specifically, the outline shape of the nozzle 12 in the cross section of the nozzle member 3 along the central axis of the nozzle 12 has the following curved line with a changing curvature radius. The curved line is continuous with the discharge port face 1*a* and an inner side 12*a* of the nozzle 12. In this curved line portion, an apex A which is a point at which the curvature radius is minimum protrudes from the discharge port face 1*a* to form a projection portion 8 around the discharge port 11 throughout the circumference of the discharge port 11. In the present exemplary embodiment, the apex A is included in the projection portion 8. The projection portion 8 has a minimum curvature radius at the apex A. Here, the height of the apex A from the discharge port face 1*a* is equal to a height h of the projection portion 8, where the height from the discharge port face 1*a* is maximum. The curvature radius becomes larger at points inside (on the side of the inner side 12*a* of the nozzle 12) and outside (on the side of the discharge port face 1*a*) the projection portion 8 with respect to the apex A. As for the outline shape of the cross section of the nozzle member 3, the curvature radius eventually becomes infinite at the inside of the projection portion 8, in other words, represents a straight line. On the other hand, at the outside of the projection portion 8, the curved line changes to a concave curve at an inflection point, then leading to the discharge port face 1*a*.

Since the apex A is located at the highest position of the projection portion 8, the apex A does not contact with ink when the nozzle 12 is filled up with ink. Since the apex A is configured as described above, the spreading of the cross section of the nozzle 12 from the separate path 6 (see FIG. 3B) to the discharge port 11 is suppressed to a minimum. This facilitates reducing a stagnation area 15*a* of ink within the nozzle 12, and as a result, an ink coagulation can hardly be generated in the nozzle 12. Therefore, even if the wiping process, which wipes the discharge port face 1*a* with a blade (not shown), is repeated, rubbing the coagulation onto the discharge port face 1*a* with the blade can be reduced. Thus, the ink-repellent layer 13 around the discharge port face 11 is maintained in a good condition. Since the ink-repellent layer 13 exists around the discharge port 11, ink can hardly adhere to a portion near the discharge port 11. Accordingly, the ink discharge direction can be stabilized.

As for the relationship between the meniscus M and the apex A of the projection portion 8, just as in the present embodiment, the apex A can be included in the projection portion 8, and the apex A can be the highest from the discharge port face 1*a*. However, practically, the apex A need not be the highest from the discharge port face 1*a* as long as the apex A is formed within the projection portion 8. Thus, a similar advantageous effect can be attained by making each of a spreading angle and a protrusion height of the projection portion 8 within a predetermined range. That is, with the spreading angle and the protrusion height of the projection portion 8 within a predetermined range as described below, a similar advantageous effect to the case where the apex A is the highest from the discharge port face 1*a* among points in the projection portion 8.

Here, in the cross section along the axis line (central axis) of the nozzle 12, the spreading angle of the projection portion 8 is defined as an angle θ between a tangent line at a point B at which the curvature radius is maximum inside the nozzle 12 and a tangent line at a point C at which the curvature radius is maximum outside the nozzle 12. If there is a plurality of points at which the curvature radius is maximum inside and outside the nozzle 12, points nearest to the apex A inside and outside the nozzle 12 are defined as the points B and C, respectively.

The spreading angle θ is set to be equal to or greater than 40° and equal to or less than 75°, and the height h of the projection portion 8 from the discharge port face 1*a* (see FIG. 4) is set to be equal to or greater than 0.05 μm and less than 0.5 μm. Accordingly, spreading of the cross-section of the nozzle 12 can be suppressed. If the spreading angle θ is too large, the projection portion 8 becomes too gentle, so that it becomes difficult to achieve the effectiveness of the projection portion 8. In contrast, if the spreading angle θ is too small, the projection portion 8 becomes too sharp, so that the mechanical strength of the projection portion 8 decreases.

The protrusion height h is determined by the height along the central axis of the nozzle 12 from the discharge port face 1*a*. If the protrusion height h is less than 0.05 μm, it becomes difficult to locate the apex A from the discharge port face 1*a* at a position higher than the position of the meniscus M formed inside the nozzle 12. On the other hand, if the protrusion height h of the projection portion 8 is equal to or greater than 0.5 μm, the conveyance of a recording medium can be influenced during recording when the ink jet recording head is actually installed in a recording apparatus. Recently, a smaller droplet for discharged ink has been implemented from the viewpoint of making a high-definition image to be recorded. To improve the impact position accuracy of discharged ink droplets onto a recording medium, a gap between the ink jet recording head and the recording medium tends to be set smaller than before. When the gap between the ink jet recording head and the recording medium is small, if the protrusion height h of the projection portion 8 is set too large, an edge of the recording medium being conveyed may be caught by the projection portion 8 so that the normal conveyance cannot be performed.

Figure 5:
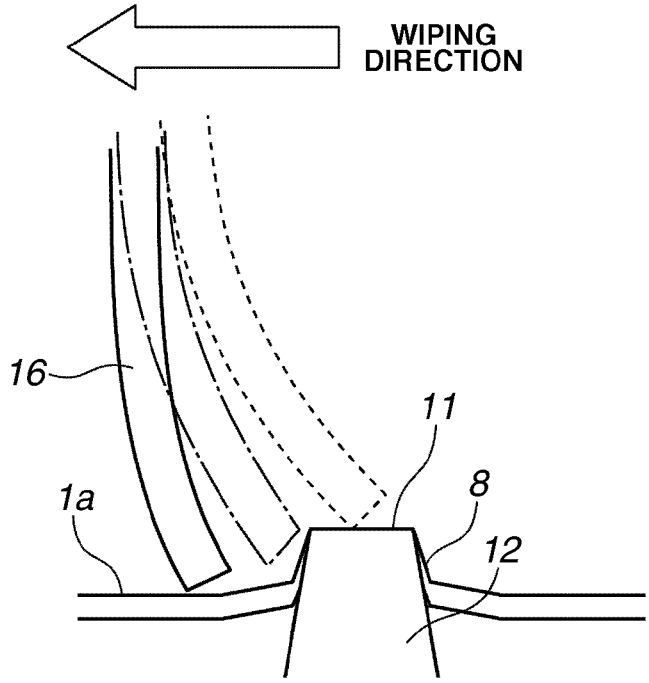
FIG. 5 illustrates the movement of a blade during a wiping operation on a discharge port face in an ink jet recording head having a projection portion around a discharge port.

Consider the case where the wiping process is performed with a blade 16, as shown in FIG. 5, in the ink jet recording head configured as described above according to the present exemplary embodiment. The blade 16 is made of, for example, a rubbery elastic material to completely wipe off the ink on the discharge port face 1*a* with a flexing movement thereof. Considering the case where the blade 16 moves in the direction of the arrow with respect to the discharge port face 1*a*, when the blade 16 is located on the discharge port 11, that is, while the blade is going over the projection portion 8 (the blade position indicated by a broken line), the blade 16 is in the most flexed state. After that, when the blade 16 goes over the projection portion 8, the blade 16 recovers by its restoration power and comes in contact with the discharge port face 1*a*. In this instance, immediately after the blade 16 has gone over the projection portion 8, the blade 16 is moving in the direction of the arrow with respect to the discharge port face 1*a*. Accordingly, the blade 16 jumps over the projection portion 8 and does not come in contact with the discharge port face 1*a*, as shown in the chain line in FIG. 5. Then, the blade 16 comes in contact with the discharge port face 1*a* at a position distant from the projection portion 8, as shown by the solid line.

Figure 6:
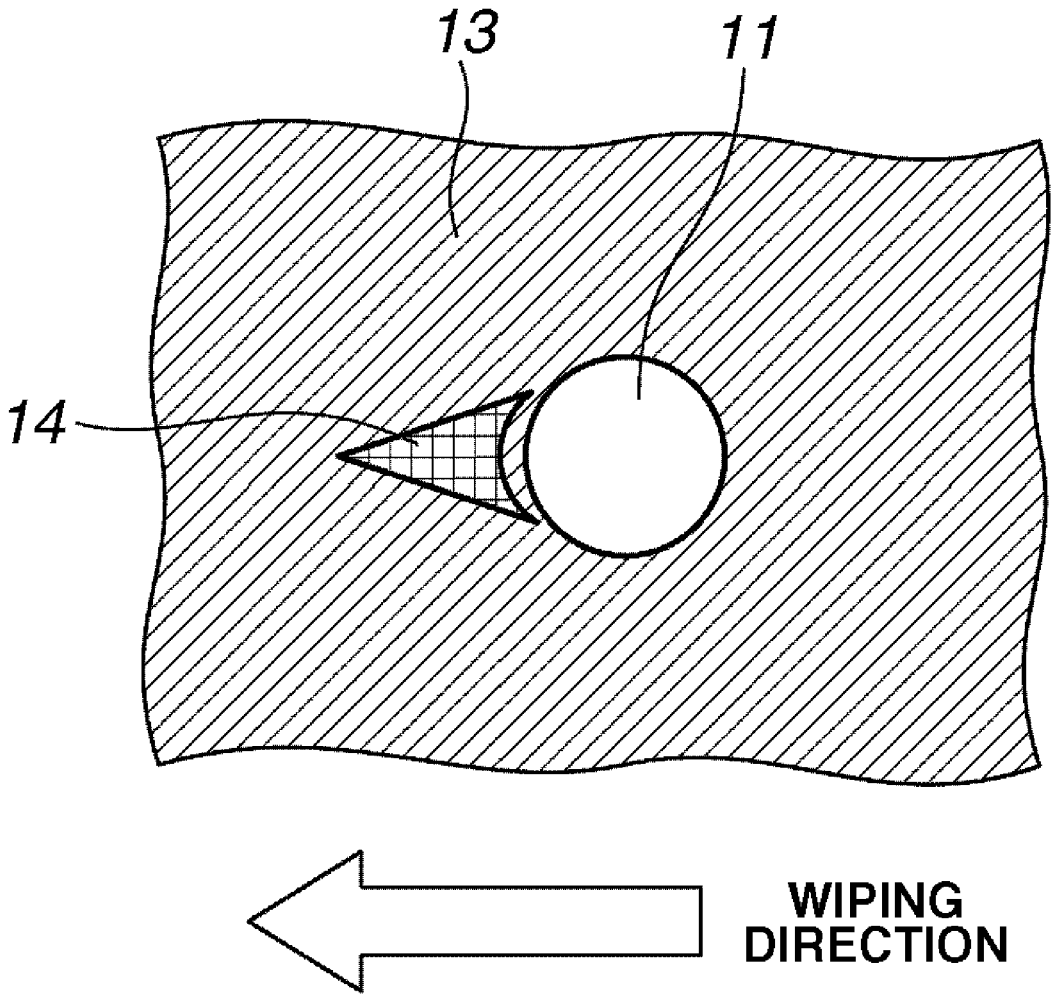
FIG. 6 is a plan view of the vicinity of the discharge port showing a state of an ink-repellent layer on the discharge port face when the wiping process is repeated in the ink jet recording head having the projection portion around the discharge port.

Because the blade 16 has the above-mentioned behavior with respect to the discharge port side 1*a*, if the ink coagulation is scraped off from the nozzle 12, the ink coagulation will be rubbed onto the discharge port face 1*a* at a position distant from the projection portion 8. As a result, damage to the discharge port face 1*a* due to rubbing of the ink coagulation occurs at a position distant from the discharge port 11. Accordingly, the area 14 susceptible to wetting with ink, which is formed by a damage (abrasion) to the ink-repellent layer 13, is located away from the discharge port 11, as shown in FIG. 6. Moreover, because the ink coagulation can hardly be generated in the nozzle 12, the size of the area 14 susceptible to wetting with ink formed at this time is much smaller than that in the conventional case show in FIG. 1. Since the ink-repellent layer 13 exists near the discharge port 11, even if ink has adhered to the area 14 susceptible to wetting when ink is discharged from the discharge port 11, discharging of ink is not influenced.

As described above, the projection portion 8 is formed around the discharge port 11 and has the above-mentioned specific shape in cross section near the discharge port 11. Accordingly, the excellent ink-repellent performance of the discharge port face 1*a* can be maintained.

An example of a method for manufacturing an ink jet recording head having the projection portion 8 that satisfies the predetermined range of the spreading angle θ and the predetermined range of the protrusion height his described below with reference to FIG. 3B.

First of all, the substrate 2 having the heating resistance elements 4 formed therein is prepared. Next, patterns for the separate flow paths 6 and the common flow path 7 are formed in the substrate 2 by using a molten resin. A positive resist can be used in the formation of these patterns. The positive resist can include a photodegradable positive resist with comparatively high molecular weight capable of keeping its shape when the nozzle member 3 is laid thereon at a later process.

Next, on the substrate 2 having the patterns for the separate flow paths 6 and the common flow path 7 formed therein, a resin material is laid covering the patterns for the separate flow paths 6 and the common flow path 7 to form the nozzle member 3. In addition, the ink-repellent layer 13 is formed on the nozzle member 3. A resin including an epoxy group is used as the ink-repellent layer 13 so that the projection portion 8 can be formed around the discharge port 11 at a later process. In addition, a resin material that can concurrently achieve all of a high ink-repellent property, an easy wiping by the blade, a durability against the blade (excellent maintenance of the ink-repellent performance), and a high sticking power to the nozzle member 3 can be used as the ink-repellent layer 13. Fluorine-containing epoxy resin that can be hardened by an exposure to ultraviolet rays is suitable as such a material of the ink-repellent layer 13. The nozzle member 3 and the ink-repellent layer 13 can be formed by a spin coating method, a direct coating method, or the like.

Next, pattern exposure and development processes are carried out on the nozzle member 3 and the ink-repellent layer 13 via a mask (not shown) to form the nozzle 12 with the discharge port 11 provided thereon.

After that, energy, such as heat, light, or electron beam, is provided to cross-link and harden the ink-repellent layer 13. At this time, a portion of the nozzle member 3 around the discharge port 11 which does not contain the epoxy resin is hardened and contracted by heat, and an upward stress acts around the discharge port 11. Accordingly, the projection portion 8 is formed around the discharge port 11.

Next, the supply port is formed on the substrate 2. Then, the patterns for the separate flow paths 6 and the common flow path 7 are melted out to form the separate flow paths 6 and the common flow path 7. Finally, a heating process is performed as required to completely harden the nozzle member 3 and the ink-repellent layer 13. The ink jet recording head 1 is completed.

As described above, the nozzle member 3 is made from a resin material, the ink-repellent layer 13 is made from a resin containing an epoxy group, the discharge port 11 is formed by the exposure and development processes, and the cross-linking process is performed on the ink-repellent layer 13. Accordingly, the projection portion 8 is formed around the discharge port 11. In addition, according to the above-described method for manufacturing the ink jet recording head 1, the spreading angle θ and the protrusion height h of the projection portion 8 can be adjusted, for example, by appropriately changing the cross-linking process condition for the ink-repellent layer 13.

An ink jet recording apparatus having the above-described inkjet recording head 1 for performing recording on a recording medium is described below.

Figure 7:
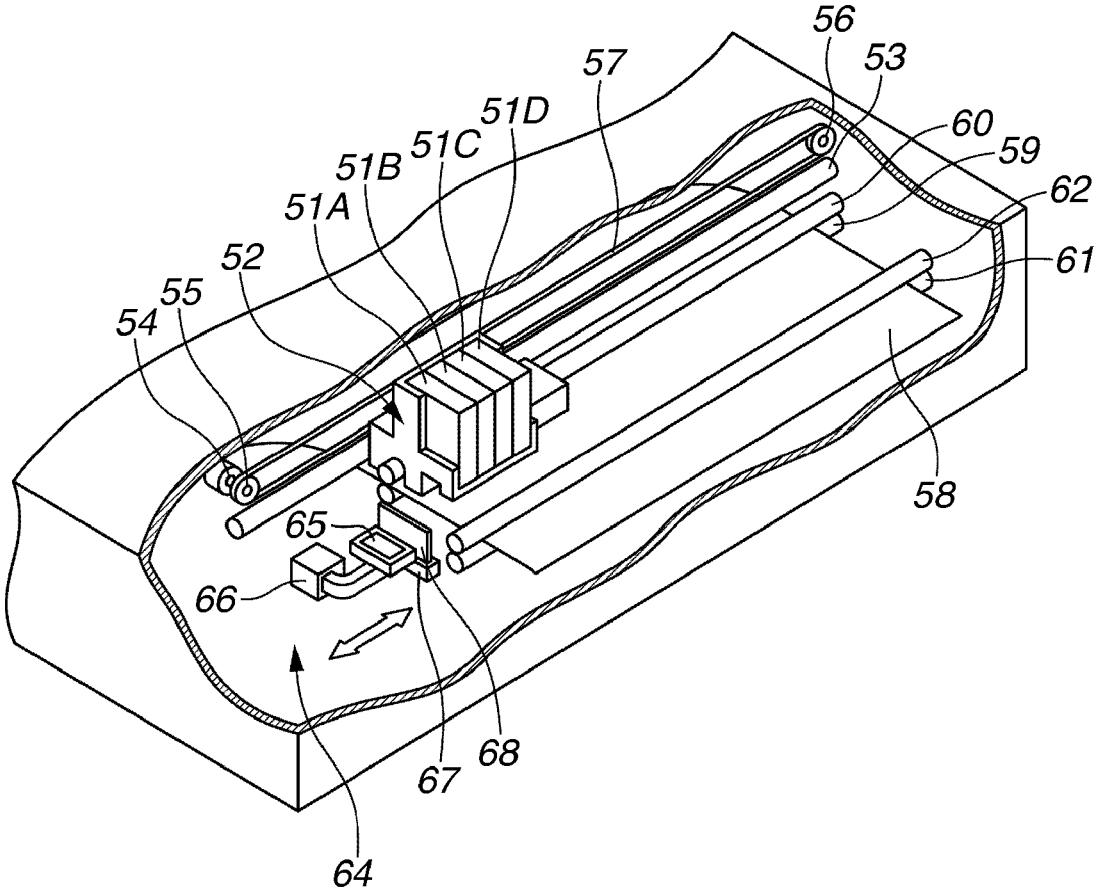
FIG. 7 is a perspective view, partially broken away, illustrating a chassis of an ink jet recording apparatus having an ink jet recording head according to an exemplary embodiment of the present invention.
Figure 8A:
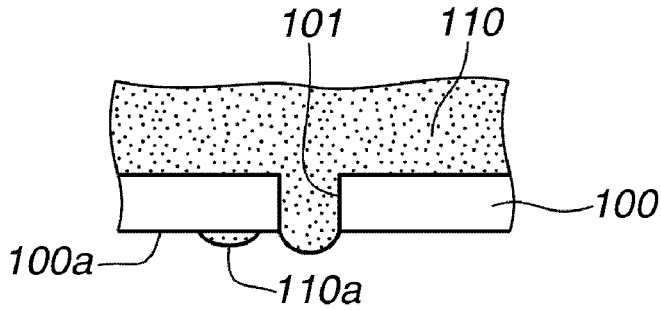
FIGS. 8A to 8D are diagrams illustrating a problem occurring in a conventional ink jet recording head.
Figure 8B:
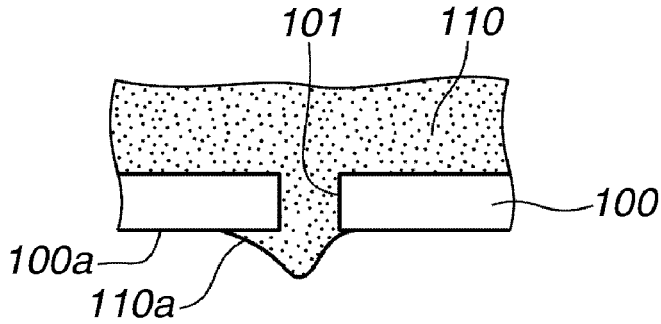
Figure 8C:
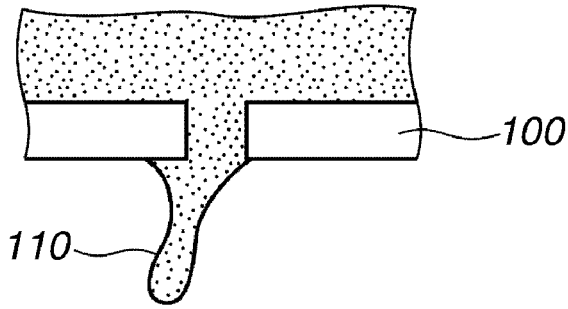
Figure 8D:
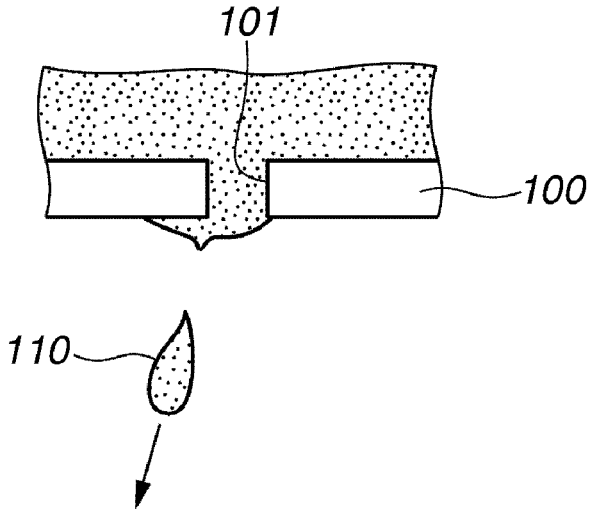

FIG. 7 is a perspective view, partially broken away, illustrating a chassis of an ink jet recording apparatus having an ink jet recording head according to an exemplary embodiment of the present invention.

Referring to FIG. 7, a carriage 52 is supported for a reciprocating movement along a guide rail 53. The carriage 52 carries four detachable head cartridges 51A to 51D. The head cartridges 51A to 51D each are composed of an ink jet recording head and an ink tank integrally formed and store different color inks, respectively. The number of head cartridges is not limited to 4, but may be changed to an appropriate number.

The carriage 52 is fixed to a portion of a belt 57 entrained around a pulley 55 coupled to a carriage drive motor 54 and a driven pulley 56. The carriage 52 can be reciprocated along the guide rail 53 according to the backward and forward rotation of the carriage drive motor 54.

A recording medium 58 is conveyed in a direction intersecting with the moving direction of the carriage 52 at a position facing the discharge ports (not shown) of the head cartridges 51A to 51D mounted on the carriage 52. Conveyance rollers 59, 60, 61, and 62 convey the recording medium 58.

While the carriage 52 scans the recording medium 58, inks are discharged onto the recording medium 58 from the ink jet recording heads of the head cartridges 51A to 51D. When the carriage 52 has moved up to one end of the recording medium 58, the conveyance rollers 59 to 62 convey the recording medium 58 by a predetermined amount. Accordingly, an image is formed on the whole recording medium 58 when the process of recording by the recording head while moving the carriage 52 and the process of conveying the recording medium 58 by the conveyance rollers 59 to 62 are alternately performed.

Further, the ink jet recording apparatus includes a recovery mechanism 64 for keeping the discharge port face of the ink jet recording head always in a good condition. The recovery mechanism 64 includes a suction cap 65 and a blade 68. The suction cap 65 caps the discharge port face of the ink jet recording head when the ink jet recording head is not in use. At the same time, the suction cap 65 sucks out a viscous ink accumulated in the nozzle by a suction force from a suction pump 66. The blade 68 removes ink and dust having adhered to the discharge port face by wiping the discharge port face with a blade edge thereof. In the present embodiment, a single blade 68 wipes all of the ink jet recording heads. The wiping process is performed according to the carriage 53 moving periodically on the blade 68.

A specific example is described below.

Several ink jet recording heads with different spreading angles θ and different protrusion heights h of the projection portion 8 shown in FIG. 4 were prepared as samples. Here, in each sample, the nozzle array density is 600 dpi, the amount of discharge of ink from each nozzle is 2 pl, and the diameter of each discharge port is 17 μm. Moreover, the protrusion height h and the spreading angle θ were measured at a diameter portion of each discharge port cut along the central axis of the nozzle. Each sample of the ink jet recording heads was mounted on a general ink jet recording apparatus having such a recovery mechanism as shown in FIG. 7, and 100,000 copies of images were continuously recorded on A4 sheets in a normal sequence of the ink jet recording apparatus. During the recording operation, the discharge port face of each ink jet recording head is periodically wiped by the blade. After 100,000 copies were recorded, the displacement in the discharge direction was evaluated. The evaluation was based on the determination standard described below.

Displacement is not observed: A

Displacement is observed to some extent but does not influence the image quality: B Displacement is observed and influences the image quality: C The protrusion heights h, the spreading angles θ, and the evaluation results after recording of 100,000 copies are summarized in Table 1.

TABLE 1

| Sample | Protrusion height h (μm) | Spreading angle θ(°) | Displacement in discharge direction |
|---|---|---|---|
| 1-1 | 0.07 | 75 | A |
| 1-2 | 0.1 | 70 | A |
| 1-3 | 0.5 | 40 | A |
| 1-4 | 0.7 | 35 | B |
| 1-5 | 0.9 | 26 | B |
| 1-6 | 0.0 | 75 | C |

As can be understood from Table 1, an excellent image recording without any displacement in the discharge direction can be performed with the spreading angle θ of the projection portion within a range of 40° to 75° inclusive. However, if the protrusion height h is 0, the displacement in the discharge direction occurs even if the spreading angle θ is 75°. Based on this result, in order to prevent the displacement in the discharge direction, the projection portion should be formed around the discharge port.

Next, the influence of the projection portion on the conveyance of a recording medium was evaluated. As evaluation samples, ink jet recording heads with different protrusion heights h and different spreading angles θ of the projection portions were prepared. The number of nozzles in each sample is 300. Each sample was mounted on an inkjet recording apparatus in a similar manner as described above, and paper feeding tests for ten consecutive sheets were performed. The paper feeding condition is a strict condition most unlikely to exist in the actual usage. After the paper feeding tests, the samples were removed from the ink jet recording apparatus, and the discharge port faces were observed to count the number of nozzles with cracked projection portions. Cracks in the projection portions occur due to edges of the recording media colliding with the projection portions. Accordingly, the larger the number of cracked projection portions, the paper jam is more likely to occur.

Table 2 shows the protrusion heights h, the spreading angles θ of the projection portions, and the number of nozzles with cracked projection portions.

TABLE 2

| Sample | Protrusion height h (μm) | Spreading angle θ(°) | Nozzles with cracked projection portions |
|---|---|---|---|
| 2-1 | 0.07 | 75 | 3 |
| 2-2 | 0.25 | 60 | 6 |
| 2-3 | 0.35 | 45 | 14 |
| 2-4 | 0.5 | 40 | approx. 150 |
| 2-5 | 0.9 | 26 | approx. 300 |
| 2-6 | 0.0 | 75 | 5 |

As can be understood from Table 2, the higher the protrusion height h, the conveyance of a recording medium becomes worse. In the present example, in the paper feeding tests, the cracks in the projection portions were observed for approximately half of the nozzles having the protrusion heights h of 0.5 μm. However, in the light of the actual usage condition, a height of less than 0.5 μm can be considered to lie within the allowable range. Moreover, if the protrusion height h is 0, the conveyance property for a recording medium is thought to be good. However, as is apparent from the result shown in Table 1, the image quality is deteriorated.

Moreover, the cross sections of nozzles of the samples 1-1 to 1-3 and 2-1 to 2-3 were observed. It was confirmed that, in a part of them, the protrusion height h was largest at the point A.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2005-256522 filed Sep. 5, 2005, which is hereby incorporated by reference herein in its entirety.

What is claimed is:

1. An ink jet recording head using pigment ink as discharged ink, comprising:

a nozzle member having a nozzle for discharging ink, the nozzle member having an ink-repellent layer forming a discharge port face having a discharge port that is an open end of the nozzle; and a projection portion positioned around the discharge port and protruding along a central axis direction of the nozzle with respect to the discharge port face, wherein the nozzle, in a cross section passing through the central axis of the nozzle, has an outline shape provided with a curved line having a changing radius of curvature, wherein an angle defined by tangent lines at points at which the curvature radius of the curved line is maximum and which are nearest to a boundary point at which the curvature radius of the curved line is minimum inside and outside the nozzle with respect to the boundary point is equal to or greater than 40° and equal to or less than 75°, and wherein a height of the projection portion from the discharge port face along the central axis direction of the nozzle is equal to or greater than 0.05 μm and less than 0.5 μm.

2. The ink jet recording head according to claim 1, wherein the nozzle member is made of a resin.

3. The ink jet recording head according to claim 1, wherein the ink-repellent layer is made of a resin including an epoxy group.

4. An ink jet recording apparatus including the ink jet recording head according to claim 1 and configured to perform recording on a recording medium by discharging ink from the ink jet recording head, the apparatus comprising:

a head mounting unit configured to mount the ink jet recording head thereon; and a conveying unit configured to convey the recording medium.

5. The ink jet recording apparatus according to claim 4, further comprising one or more blades configured to wipe the discharge port face of the ink jet recording head.

* * * * *